United States Patent [19]

Satake

[11] 4,377,116

[45] Mar. 22, 1983

[54] FURNACE FOR BURNING HUSK

[75] Inventor: Toshihiko Satake, Higashihiroshima, Japan

[73] Assignee: Satake Engineering Co. Ltd., Tokyo, Japan

[21] Appl. No.: 295,712

[22] Filed: Aug. 24, 1981

[30] Foreign Application Priority Data

Aug. 27, 1980 [JP] Japan ..... 55/118699
Mar. 1, 1981 [JP] Japan ..... 56/32935

[51] Int. Cl.[3] ..... F23G 3/00

[52] U.S. Cl. ..... 110/235; 110/110; 110/197; 110/210; 110/229; 110/255

[58] Field of Search ..... 110/197, 102, 235, 255, 110/257, 210, 211, 110, 346, 229

[56] References Cited

U.S. PATENT DOCUMENTS

| | | | |
|---|---|---|---|
| 607,553 | 7/1898 | Smead | 110/255 |
| 4,203,374 | 5/1980 | Frederick | 110/255 X |
| 4,300,456 | 11/1981 | Messersmith | 110/102 |
| 4,306,506 | 12/1981 | Rotter | 110/255 X |
| 4,312,278 | 1/1982 | Smith et al. | 110/102 X |

*Primary Examiner*—Edward G. Favors
*Attorney, Agent, or Firm*—Norbert P. Holler

[57] ABSTRACT

A husk burning furnace having a husk smoke-burning chamber formed by an inner peripheral perforated wall defining a pot-shaped primary gas burning chamber and an outer peripheral perforated wall surrounding the inner peripheral perforated wall. Means are provided to feed the husk particles into the smoke-burning chamber from the lower side of the latter in a floating manner where they are smoke-burnt to become smoke-carbonized husk particles, while generating unburnt gas. The smoke-carbonized husk particles are taken out of the furnace while the unburnt gas is introduced into the primary gas burning chamber so as to be burnt in the primary gas burning chamber. The gas together with flame is introduced further into a secondary gas burning chamber connected to the upper end of the inner peripheral perforated wall to generate colorless hot gas containing no substantial quantities of dust particles. Meanwhile, the smoke-carbonized husk particles are suitably discharged to the desired place.

6 Claims, 2 Drawing Figures

FURNACE FOR BURNING HUSK

BACKGROUND OF THE INVENTION

The present invention relates to an improvement in a furnace for burning various granular fuels or materials, particularly, but not exclusively, particles of husk.

Hitherto, there are only few effective and economical husk burning furnaces successfully put into practical use. Namely, the husk burning furnaces proposed have various drawbacks. First of all, it is to be pointed out that, in the conventional husk burning furnaces, the husk particles are completely burned down into white ash because of high burning temperature, and the ash is merged into the hot air coming out from the furnace to contaminate the hot air. In addition, since the conventional husk burning furnaces are not adapted to effect a smoke carbonization of the husk particles, it is not possible to make use of the carbonized husk particles as a fuel nor to return the same into soil. Furthermore, since the conventional husk burning furnaces are constructed to burn the husk particles while the latter are falling from the upper side, the ash is inconveniently scattered to make the discharge of the ash difficult. Finally, it is also to be pointed out that the walls of the furnace are overheated due to the high temperature of the flame to cause a distortion of the furnace chamber and a rapid burning down of the furnace wall resulting in a short life of the burning furnace.

SUMMARY OF THE INVENTION

Accordingly, an object of the invention is to provide an improved husk burning furnace which can overcome or eliminate all of the above-described problems of the prior art.

To this end, according to one aspect of the invention, there is provided a husk burning furnace characterized by comprising, in combination, an inner peripheral perforated wall defining a pot-like cylindrical primary gas burning chamber provided at its upper end with an opening constituting a hot gas outlet, an outer peripheral perforated wall surrounding the inner peripheral perforated wall and defining therebetween a conically annular husk smoke-burning chamber provided with a husk supply port opening at a lower part thereof, a husk supplying device connected to the husk supply port and adapted to forcibly move husk particles upwardly to feed and supply the latter, a secondary gas burning chamber connected to the upper end of the hot gas outlet, a hot gas discharge port communicated with the secondary gas burning chamber, a smoke-carbon discharge port adapted to upwardly discharge the husk particles smoke-carbonized in the smoke burning chamber, and an outer cylindrical wall accommodating the above-mentioned constituents.

According to another aspect of the invention, there is provided a husk burning chamber of the type mentioned above, characterized by further comprising a floor wall interconnecting the upper part of the outer peripheral perforated wall to the inner peripheral surface of the outer cylindrical wall, a multiplicity of slots arranged circumferentially and extending obliquely upwardly through the floor wall and a blower communicating with the slots through an air passage provided at the lower side of the floor wall, wherein the smoked-carbon discharge port opens in the outer cylindrical wall contacted at its inner side by the floor wall.

In the husk burning furnace of the invention having the above-described construction, the space defined between the inner peripheral perforated wall constituting the primary gas burning chamber and the outer peripheral perforated wall surrounding the lower portion of the inner peripheral perforated wall constitutes a smoked-burning chamber for burning the husk particles. The husk particles supplied to this chamber from the lower side are progressively smoke-burnt and smoke-carbonized to become black ash as they move upwardly through this chamber and are discharged in a floating manner from the upper end of this chamber. The black ash is conveyed by being entrained in a spiral flow of air and discharged to the outside of the furnace, while only the unburnt gas generated during the smoke-burning is made to flow into the central portion of the primary gas burning chamber through the inner peripheral perforated wall to be burnt at the central portion of this chamber. Therefore, the flame of high temperature does not contact this inner peripheral perforated wall constituting this furnace wall so that the distortion or burn out of the furnace chamber, which is inevitable in the conventional furnace of the kind described, is avoided to ensure the safety of the furnace. The residual unburnt gas still remaining in the hot gas discharged from the primary gas burning chamber is further burnt in the secondary gas burning chamber and the hot gas generated as a result of burning in this secondary gas burning chamber is finally discharged to the outside of the furnace. It is thus possible to stably generate the hot gas continuously, and to attain a "clean" burning of the husk particles.

By way of example only, an illustrative embodiment of the invention will now be described with reference to the accompanying drawings.

DESCRIPTION OF THE PREFERRED EMBODIMENTS

Figure 1:
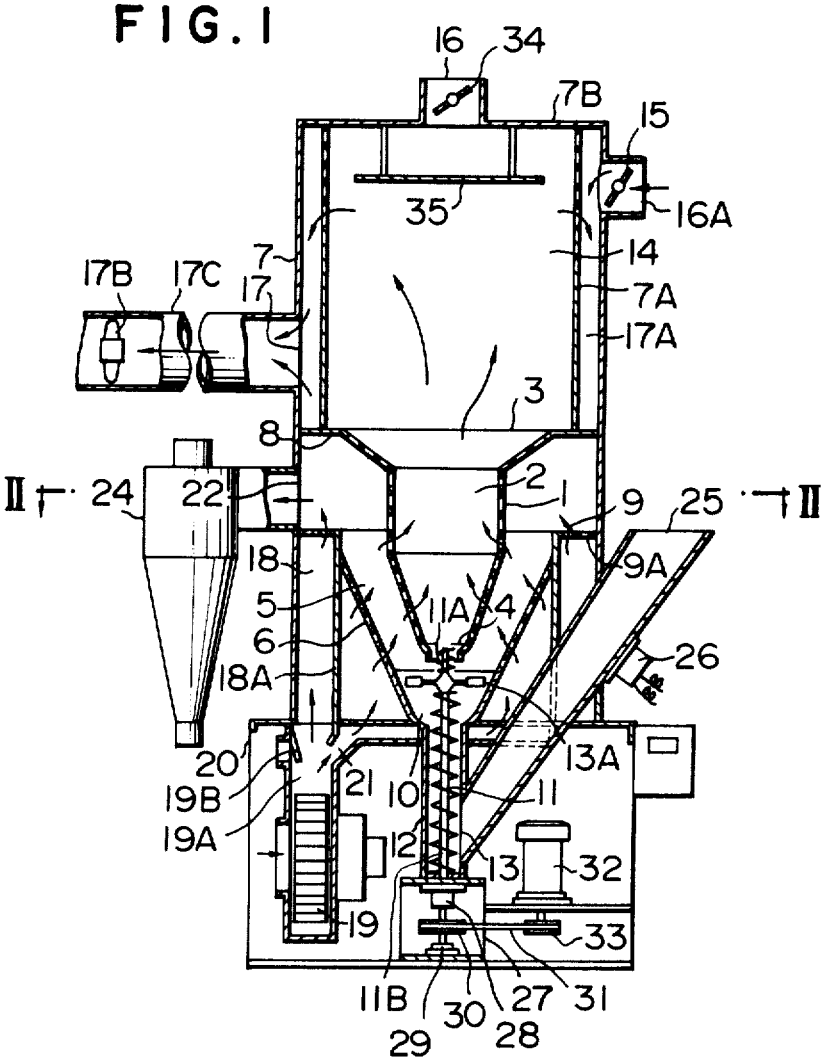
FIG. 1 is a vertical sectional view of a husk burning furnace in accordance with an embodiment of the invention.
Figure 2:
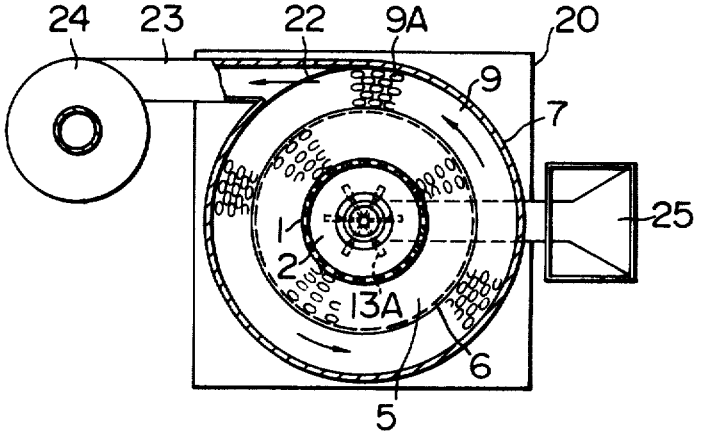
FIG. 2 is a horizontal sectional view taken along the line II—II of FIG. 1.

Referring to the drawings, a pot-shaped cylindrical primary gas burning chamber 2 is formed by an inner peripheral perforated wall 1. The upper open end of this chamber 2 constitutes a hot gas outlet 3 while the lower open end of the same serves as an ash dropping opening 4. An outer peripheral perforated wall 6 surrounding the inner peripheral perforated wall 1 defines therebetween a husk smoke-burning chamber 5. The inner peripheral perforated wall 1 is supported by means of a top panel 8 of the smoke-burning chamber interconnecting the upper brim of the hot gas outlet 3 to an outer cylindrical wall 7, while the outer peripheral perforated wall 6 is supported by means of a floor wall 9 which interconnects the wall 6 to the outer cylindrical wall 7. The lower part of the outer peripheral perforated wall 6, which does not face the inner peripheral perforated wall 1 is made to have a funnel-like shape devoid of perforations, with the lower end thereof opened to form a husk supply port 10. A feed sleeve 12 accommodating a spiral feed screw 11 with a vertical shaft is connected to the husk supply port 10, so as to form a husk supplying device 13. The spiral feed screw 11 is provided at its upper end with a diffusion blade 13A of an increased diameter. A reverse spiral screw 11A having a reverse screw to that of the screw 11 is attached to the upper end of the diffusion blade 13A and is received by the ash drop opening 4. To the upper end of the hot gas outlet 3 leading from the primary gas burning chamber 2 is connected a secondary gas burning chamber 14 defined by an inner cylindrical wall 7A concentric with the outer cylindrical wall 7. The lower end of the inner cylindrical wall 7A is connected to the top panel 8, while the upper end of the same is connected to the top wall 7B of the outer cylindrical wall 7. Also, the inner cylindrical wall 7A is provided at its upper end with a multiplicity of perforations. The upper portion of the outer cylindrical wall 7 surrounding the secondary gas burning chamber is provided with an air introduction port 16A having a regulating valve 15. The interior of the secondary gas burning chamber is communicated with a discharge pipe 17C having a draft fan 17B, through the perforations of the inner cylindrical wall 7A, an annular hot gas passage 17A defined between the inner and outer cylindrical walls, and a hot gas discharge port 17 provided in the outer cylindrical wall 7. The floor wall 9 is provided therein with a multiplicity of slots 9A arranged circumferentially and extending obliquely upwardly to generate a swirling flow. These slots are communicated with an air passage 19A of a blower 19 mounted in a base 20 supporting the outer cylindrical wall 7, through an annular air passage defined between the portion of the outer cylindrical wall outside the perforated wall 6 and an inner wall 18A concentric with the latter. A change-over valve 19B is disposed in the air passage 19A while an air inlet 21 for supplying the air into the smoke-burning chamber 5 is connected to the air passage 19A. As will be seen from FIG. 2, a smoke-carbon discharge port 22 is provided on the connection between the floor wall 9 and the outer cylindrical wall 7, in the tangential direction to the floor wall 9, and is connected through a pipe 23 to a cyclone 24 provided with a draft fan.

A husk supply chute 25 extending obliquely downwardly from the outside of the outer cylinder 7 is connected to the husk supplying device 13. The chute 25 is provided with an electromagnetic vibrator 26 for promoting the flowing down of the husk particles. The spiral feed screw 11, diffuser blade 13A and the reverse spiral screw 11A are carried by a shaft 11B which in turn is supported rotatably by means of bearings 28, 29 carried by a bracket 27 provided in the base 20. The shaft 11B has a pulley 30 which is drivingly connected through a belt 31 to a pulley 33 of a motor 32 mounted in the base 20.

The gas discharge port 16 provided at the top of the secondary gas burning chamber 14 is preferably provided with an automatic stop valve 34 adapted to automatically open when the blower 19 and the draft fan 17B are stopped thereby to prevent explosion of residual gas. A reference numeral 35 denotes a baffle plate suspended from the top wall 7B.

The hot gas coming out through the discharge pipe 17C is used as a heat source for various purposes such as drying of the husk particles, heating of hot-house and so forth. In the case where a temperature control is necessary in the heated object, the temperature control may be achieved by, for example, the following arrangement. Namely, in such a case, a variable speed motor is used as the motor 32 such that the speed is controlled in accordance with an output from a thermostat disposed at a suitable position near the heated object, so that the temperature may be controlled suitably by changing the rate of supply of the husk particles by the husk supplying device 13.

The husk burning furnace of the described embodiment operates in a manner explained hereinunder. As the motor 32 is started after filling the husk chute 25 with the husk particles, the husk particles are forced to move upwardly by the rotation of the spiral feed screw 11 to fill up the smoke-burning chamber 5. Then, the top portion of the mass of husk particles in the smoke-burning chamber 5 is ignited by a suitable ignition means (not shown). The supply of the husk particles into the chamber 5 is continued by the husk supplying device 13. At the start of the burning, the change-over valve 19B is operated to close the annular air passage 18 and the blower 19 is operated so that the air from the blower 19 is supplied through the air port 21 and then the perforations of the outer peripheral perforated wall 6 into the smoke-burning chamber 5 to red-heat the husk particles in the latter. The surplus air and the unburnt gas generated from the husk particles are made to flow into the primary gas burning chamber 2 through the perforations of the inner peripheral wall 1 and the unburnt gas is burnt at the central portion of the primary gas burning chamber to form a flame which is introduced into the secondary gas burning chamber 14 through the flame or hot gas outlet 3. The unburnt gas is then completely burnt in the secondary gas burning chamber 14.

Then, as the red-heated upper layer of the husk particles in the smoke-burning chamber begins to flow down onto the floor wall 9 in a manner like an avalanche, the change-over valve 19 is operated to open the annular air passage 18. The air supplied by the blower 19 into the annular air passage 18 is made to flow out in a spiral manner as shown by arrow in FIG. 2 through the multiplicity of slots 9A formed in the floor wall 9, so that the smoke-carbonized husk particles, i.e. black ash, coming down from the top of the smoke-burning chamber 5 onto the floor wall 9 are conveyed by the upward spiral flow of air formed on the floor wall 9 so as to be discharged into the cyclone 24 having a draft fan, through the smoked carbon discharge port 22 and the pipe 23. A part of the air discharged from the slots 9A is supplied as a secondary air into the secondary gas burning chamber through the lower side of the latter to promote the perfect burning in this chamber. The hot gas generated as the result of burning in the secondary gas burning chamber is induced by the draft fan 17B through the perforations at the upper part of the inner cylindrical wall 7A, hot gas passage 17A and the hot gas discharge port 17, and is released to the discharge pipe 17C. By suitably opening the regulating valve 15 mounted in the air introduction port 16, cold ambient air is sucked and introduced to lower the temperature of the hot gas flowing in the hot gas passage 17A thereby to prevent excessive temperature rise of the inner cylindrical wall 17 and to control the temperature of the hot gas distributed through the discharge pipe 17C to the portions requiring the heating.

The reverse spiral screw 11A received by the ash drop opening 4 of the primary gas burning chamber 2 acts to return the ash, which comes into the primary gas burning chamber 2 through the inner peripheral perforated wall 1, into the husk particles at the bottom of the smoke-burning chamber 5 thereby to avoid various problems which may, for otherwise, be caused due to accumulation of the dropping ash in the secondary gas burning chamber.

The perforated walls of the described embodiment may be formed of a refractory material. By so doing, it is possible to further improve the durability of the furnace.

As will be understood from the foregoing description, according to the invention, the undesirable mixing of the smoke-carbonized husk particles in the hot gas is prevented because the smoke-carbonized husk particles are isolated by the perforated wall. In addition, the burning down of the perforated walls is avoided because they are maintained at a sufficiently low temperature. Furthermore, since the carbonized husk particles are fed in a floating manner from the lower side of the smoke-burning chamber 5, in contrast to the prior art furnace in which the carbonized husk particles are moved downwardly to cause an excessive packing of the ash on the bottom of the burning chamber, the ash is smoothly and continuously discharged to make it possible to discharge the carbonized ash to the desired place. According to the invention, it is thus possible to achieve a safe and clean work for burning husk particles by a stable burning, while producing colorless hot gas containing no substantial dust particles.

What is claimed is:

1. A husk burning furnace characterized by comprising, in combination, an inner peripheral perforated wall defining a pot-like cylindrical primary gas burning chamber provided at its upper end with an opening constituting a hot gas outlet, an outer peripheral perforated wall surrounding said inner peripheral perforated wall and defining therebetween a conically annular husk smoke-burning chamber provided with a husk supply port opening at a lower part thereof, a husk supplying device connected to said husk supply port and adapted to forcibly move husk particles upwardly to feed and supply the latter, a secondary gas burning chamber connected to the upper end of said hot gas outlet, a hot gas discharge port communicated with said secondary gas burning chamber, a smoked-carbon discharge port adapted to upwardly discharge the husk particles smoke-carbonized in said smoke-burning chamber, and an outer cylindrical wall accommodating the above-mentioned constituents.

2. A husk burning chamber as claimed in claim 1, characterized by further comprising a floor wall interconnecting the upper part of said outer peripheral perforated wall to the inner peripheral surface of said outer cylindrical wall, a multiplicity of slots arranged circumferentially and extending obliquely upwardly through said floor wall and a blower communicating with said slots through an air passage provided at the lower side of said floor wall, wherein the smoked-carbon discharge port opens in said outer cylindrical wall contacted at its inner side by the floor wall.

3. A husk burning furnace as claimed in claim 1, wherein the top panel of said smoke-burning chamber is constituted by a partition wall connected between the brim of said hot gas outlet and the inner surface of said outer cylindrical wall.

4. A husk burning chamber as claimed in claim 1, wherein the lower portion of said smoke-burning chamber is shaped into a funnel-like shape along the lower portion of said pot-shaped primary gas burning chamber, characterized by further comprising a sleeve connected to a husk supply port formed at the lower end of said smoke-burning chamber so as to extend downwardly from said husk supply port, a spiral feed screw with a vertical shaft and mounted in said sleeve, and a diffusion blade having a greater diameter than said spiral feed screw and attached to the upper end of the latter.

5. A husk burning furnace as claimed in claim 1, wherein the lower part of said outer peripheral perforated wall defining said smoke-burning chamber and not confronting said primary gas burning chamber is devoid of perforations.

6. A husk burning furnace as claimed in claim 1, characterized by further comprising an air introduction port with a regulating valve, said air introduction port opening to a hot gas passage between said secondary gas burning chamber and said hot gas discharge port, thereby to permit the adjustment of temperature of the hot gas coming from said secondary gas burning chamber.

* * * * *